US007367926B2

(12) United States Patent
Clark

(10) Patent No.: US 7,367,926 B2
(45) Date of Patent: May 6, 2008

(54) EXERCISE TREADMILL

(75) Inventor: Michael R. Clark, Wadsworth, OH (US)

(73) Assignee: Fitness Quest Inc., Canton, OH (US)

( * ) Notice: Subject to any disclaimer, the term of this patent is extended or adjusted under 35 U.S.C. 154(b) by 164 days.

(21) Appl. No.: 11/340,168

(22) Filed: Jan. 26, 2006

(65) Prior Publication Data

US 2007/0027003 A1 Feb. 1, 2007

Related U.S. Application Data

(60) Provisional application No. 60/704,303, filed on Aug. 1, 2005, provisional application No. 60/710,758, filed on Aug. 24, 2005.

(51) Int. Cl.
*A63B 22/02* (2006.01)

(52) U.S. Cl. ..... 482/54; 482/908; 482/909

(58) Field of Classification Search ..... 482/909
See application file for complete search history.

(56) References Cited

U.S. PATENT DOCUMENTS

| | | | |
|---|---|---|---|
| 2,399,915 | A | 5/1946 | Drake |
| 3,628,654 | A | 12/1971 | Haracz |
| 3,659,845 | A | 5/1972 | Quinton |
| 3,689,066 | A | 9/1972 | Hagen |
| 3,815,960 | A | 6/1974 | Russ, Sr. et al. |
| 4,063,726 | A | 12/1977 | Wilson |
| 4,146,222 | A | 3/1979 | Hribar |
| 4,149,624 | A | 4/1979 | Douty et al. |
| 4,151,988 | A | 5/1979 | Nabinger |
| 4,167,938 | A | 9/1979 | Remih |
| 4,226,325 | A | 10/1980 | Vandas |
| 4,350,336 | A | 9/1982 | Hanford |
| 4,364,556 | A | 12/1982 | Otte |

(Continued)

FOREIGN PATENT DOCUMENTS

EP 1186322 A2 3/2002

(Continued)

OTHER PUBLICATIONS

International Search Report. Apr. 24, 2007.

(Continued)

*Primary Examiner*—Brian D Nash
*Assistant Examiner*—Ryan Durcik
(74) *Attorney, Agent, or Firm*—Brouse McDowell; Heather M. Barnes

(57) ABSTRACT

A new and improved exercise treadmill may include a frame having a first end and a second end, wherein the second end is parallel to the first end. Two sidewalls interconnect the first and second end. The treadmill may further comprise a motor in order to drive a belt, which is trained over a front roller and a rear roller. A deck is positioned underneath the belt in order to support the user. The treadmill may also comprise a belt tensioning device, which provides a visual indicator so that the rear roller may be moved on each end in equal distance relative to the front roller. Another feature of the invention is a slot between the side rails and the frame so that an extended member can be inserted therein to lubricate the belt.

16 Claims, 18 Drawing Sheets

U.S. PATENT DOCUMENTS 4,374,587 A 2/1983 Ogden
4,423,864 A 1/1984 Wiik
4,534,748 A 8/1985 Stieg et al.
4,537,285 A 8/1985 Brown et al.
4,548,405 A 10/1985 Lee et al.
4,566,689 A 1/1986 Ogden
4,571,216 A 2/1986 Stieg et al.
4,591,147 A 5/1986 Smith et al.
4,602,779 A 7/1986 Ogden
4,614,337 A 9/1986 Schönenberger
4,635,928 A 1/1987 Ogden et al.
4,664,646 A 5/1987 Rorabaugh
4,693,363 A 9/1987 Kuehnert
4,742,257 A 5/1988 Carpenter
4,757,987 A 7/1988 Allemand
4,842,266 A 6/1989 Sweeney, Sr. et al.
4,872,664 A 10/1989 Parker
4,908,538 A 3/1990 Geberth, Jr.
4,926,863 A 5/1990 Alt
4,938,473 A 7/1990 Lee et al.
4,944,385 A 7/1990 Shelby
4,958,832 A * 9/1990 Kim ..... 482/61
4,984,810 A 1/1991 Stearns et al.
5,100,127 A 3/1992 Melnick et al.
5,163,885 A * 11/1992 Wanzer et al. ..... 482/54
5,279,528 A 1/1994 Dalebout et al.
5,289,899 A 3/1994 King
5,302,162 A * 4/1994 Pasero ..... 482/54
5,318,491 A 6/1994 Houston
5,336,144 A 8/1994 Rodden
5,382,207 A 1/1995 Skowronski et al.
5,433,679 A 7/1995 Szymczak et al.
5,441,468 A 8/1995 Deckers et al.
5,447,479 A * 9/1995 Gvoich ..... 482/54
5,454,772 A 10/1995 Rodden
5,484,362 A 1/1996 Skowronski et al.
5,492,517 A 2/1996 Bostic et al.
5,512,025 A 4/1996 Dalebout et al.
5,527,245 A 6/1996 Dalebout et al.
5,529,553 A * 6/1996 Finlayson ..... 482/54
5,542,892 A 8/1996 Buhler
5,591,106 A 1/1997 Dalebout et al.
5,595,556 A 1/1997 Dalebout et al.
5,599,259 A 2/1997 Skowronski et al.
5,626,538 A 5/1997 Dalebout et al.
5,643,144 A 7/1997 Trulaske
5,645,509 A 7/1997 Brewer et al.
5,649,882 A * 7/1997 Parikh et al. ..... 482/54
5,662,557 A 9/1997 Watterson et al.
5,665,032 A 9/1997 Chen
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,332 A 11/1997 Watterson et al.
5,702,325 A 12/1997 Watterson et al.
5,704,879 A 1/1998 Watterson et al.
5,718,657 A 2/1998 Dalebout et al.
5,733,229 A 3/1998 Dalebout et al.
5,743,833 A 4/1998 Watterson et al.
5,752,897 A 5/1998 Skowronski et al.
5,772,560 A 6/1998 Watterson et al.
5,780,946 A 7/1998 Nakamura et al.
5,827,155 A 10/1998 Jensen et al.
5,860,893 A 1/1999 Watterson et al.
5,860,894 A 1/1999 Dalebout et al.
5,899,834 A 5/1999 Dalebout et al.
5,913,384 A 6/1999 Williams
5,921,892 A 7/1999 Easton
5,951,441 A 9/1999 Dalebout et al.
6,013,011 A 1/2000 Moore et al.
6,033,347 A 3/2000 Dalebout et al.
6,053,848 A 4/2000 Eschenbach
6,071,354 A 6/2000 Williams
6,095,951 A 8/2000 Skowronski et al.
6,113,519 A 9/2000 Goto
6,123,649 A 9/2000 Lee et al.
6,179,753 B1 1/2001 Barker et al.
6,280,362 B1 8/2001 Dalebout et al.
6,287,240 B1 9/2001 Trabbic
6,300,694 B1 10/2001 Wang et al.
6,312,363 B1 11/2001 Watterson et al.
6,328,077 B1 12/2001 Mol
6,334,839 B1 1/2002 Lim et al.
D453,543 S 2/2002 Cutler
D453,948 S 2/2002 Cutler
6,350,218 B1 2/2002 Dalebout et al.
6,436,008 B1 8/2002 Skowronski et al.
6,455,960 B1 * 9/2002 Trago et al. ..... 310/64
6,458,060 B1 10/2002 Watterson et al.
6,471,622 B1 10/2002 Hammer et al.
6,478,720 B1 11/2002 Barker
6,520,891 B1 2/2003 Stephens, Jr.
6,569,062 B2 5/2003 Wang et al.
6,572,513 B1 6/2003 Whan-Tong et al.
6,589,138 B2 7/2003 Dyer et al.
6,607,469 B2 * 8/2003 Ota ..... 482/54
6,609,478 B2 8/2003 Del Valle
6,626,799 B2 9/2003 Watterson et al.
6,626,803 B1 9/2003 Oglesby et al.
6,730,002 B2 5/2004 Hald et al.
6,743,153 B2 6/2004 Watterson et al.
6,761,667 B1 7/2004 Cutler et al.
6,776,740 B1 8/2004 Anderson et al.
6,786,852 B2 9/2004 Watterson et al.
6,821,230 B2 11/2004 Dalebout et al.
6,830,540 B2 12/2004 Watterson et al.
6,846,274 B2 1/2005 Lopez-Santillana et al.
6,878,099 B2 4/2005 Corbalis et al.
6,918,858 B2 7/2005 Watterson et al.
6,923,746 B1 8/2005 Skowronski et al.
7,156,777 B2 * 1/2007 Dyer et al. ..... 482/54
2001/0016542 A1 8/2001 Yoshimura
2002/0082146 A1 6/2002 Steans
2003/0040405 A1 2/2003 Watterson et al.
2003/0073545 A1 4/2003 Liu et al.
2003/0125165 A1 * 7/2003 Trevino et al. ..... 482/54
2003/0139261 A1 7/2003 Kuo
2004/0018916 A1 1/2004 Marin et al.
2004/0018917 A1 1/2004 Corbalis et al.
2004/0018918 A1 1/2004 Reyes et al.
2004/0132583 A1 7/2004 Ohrt et al.

FOREIGN PATENT DOCUMENTS

EP 1186322 A2 3/2002
FR 2 616 132 6/1987
FR 2 623 410 11/1988

OTHER PUBLICATIONS

International Search Report, 6 pages. Jun. 15, 2007.
U.S. Appl. No. 07/368,450, Skowronski.
U.S. Appl. No. 07/452,885, Skowronski.

* cited by examiner

EXERCISE TREADMILL

This application claims priority from a provisional patent application having Ser. No. 60/704,303, which was filed Aug. 1, 2005. This application also claims priority from a provisional patent application having Ser. No. 60/710,758, which was filed Aug. 24, 2005. Both provisional patent applications are incorporated herein by reference.

I. BACKGROUND OF THE INVENTION

A. Field of Invention

This invention pertains to the art of methods and apparatuses for exercise treadmills. More specifically, it pertains to apparatuses and methods for various features of exercise treadmills, including but not limited to, one touch program buttons, a belt tensioning device, resilient support members to provide shock absorption, and mechanisms for easy treadmill maintenance.

B. Description of the Related Art

It is known in the art that exercise combined with a well balanced diet is important for good general health. Many exercise through various means including working out at home, taking advantage of good weather by jogging or walking outside, and many frequent their local gym. Regardless of the location, walking, jogging, and running are some of the most common and popular methods of achieving a cardiovascular work-out. For the exerciser's convenience, a treadmill is often utilized at home or at a gym. Treadmills to date, have served their intended purpose. They provide a variety of functions, including various speeds, various deck inclination, shock absorption, and even foldability for easy storage when the treadmill is not in use. However, despite the numerous features found in treadmills today, many problems still exist with respect to programming keys, treadmill maintenance, and the ability to maintain proper tension on the treadmill belt.

With respect to programming keys on a console, normally, there are pictures of various programs on the console. As a user chooses which program to use, they must press a "select" key and then an "enter" key. The user may also need to use arrows keys to scroll through the various program choices. This may become cumbersome and frustrating to the user as they try to switch between programs. As such, there is a need in the art to construct a console for a treadmill that has one-touch programmability.

Another problem in the art is the ability to maintain proper belt tension on the treadmill belt. To date, there are mechanisms available to tighten the belt by increasing the distance between the front and rear roller. Usually, it is the rear roller that is adjusted while the front roller remains stationary. It is difficult to use because current devices utilize Allen screws. In some embodiments, the user has two allen screws. One has to be turned clockwise, and the other has to be turned counterclockwise. One of the problems associated with these designs is the awkwardness of fitting an allen wrench into the screws for adjustment.

Another problem with belt tensioning devices is the lack of a visual indicator. Without a visual indicator, a consumer can easily over tighten one side of the rear roller so that it is farther or closer than the other side. If one of the treadmill rollers is even a little bit off, meaning not parallel with the other roller, it can cause the belt to wander and the motor to overstress. By providing a visual indicator on both sides of the roller, the user can easily adjust the distance between the rollers for even belt tension. By providing instant feedback to the user, the adjustment is easy and no guesswork is required.

Still yet, another problem faced by treadmill users is maintenance. Over time, belts need to be lubricated in order to reduce friction between the belt and the deck. The difficulty in lubricating the belt is obtaining access to the deck. Normally, when a user decides to clean the underside of a deck, the preferred method is to lift the belt, which may cause the belt to stretch, and to slide something underneath it. More and more treadmills are manufactured where one side of the belt actually disappears under the side paneling. Because the belt is trained around the rollers at high tension, it is very difficult to access the deck without torquing the belt, stretching the belt, or causing the belt to lift up. As such, there is a need in the art to provide access to the belt so that it can be easily lubricated without compromising the characteristics of the belt.

II. SUMMARY OF THE INVENTION

According to one aspect of the present invention, a new and improved exercise treadmill is provided which comprises a frame having a first end and a second end, wherein the second end is parallel to the first end. Two side rails interconnect the first and second ends of the frame. The treadmill may further comprise a motor in order to drive a belt, which is trained over a front roller and a rear roller. A deck is positioned underneath a top run of the belt in order to support the user. At the first end of the treadmill, first and second arms extend upwardly and terminate in the protective shroud. The shroud may further comprise a console which contains push buttons for operating various programs while using the treadmill. The treadmill may further comprise two handles, which extend parallel to the deck.

One object of the present invention is to provide a treadmill that may comprise a console that may have programs which may be started by pushing one button.

It is another object of the present invention to provide a belt tensioning device, which provides a visual indicator so that the rear roller may be moved on each end in equal distance relative to the front roller.

It is yet another object of the present invention to provide a belt tensioning mechanism, wherein the rear roller may be displaced by turning a knob at the end of the treadmill.

Another object of the present invention is to provide a belt tensioning mechanism, where the visual indication may be by a scale having indicia, such as letters or numbers.

It is yet another object of the present invention to provide a treadmill that has a visual indicator that is digital.

It is yet another object of the present invention to provide an exercise treadmill which comprises a space within or beside the side rails so that an extended member may be easily inserted beneath the belt and over the deck in order to lubricate the belt.

It is yet another object of the present invention to provide an exercise treadmill that may have a maintenance mechanism that comprises a wiper, which may be selectively positioned in order to remove dust and other debris off the underside of the belt.

Another object of the present invention is to provide an exercise device, comprising a frame, a rod operatively connected to the frame, protrusion means for turning the rod; and, an indicator adapted to track the number of revolutions of the rod.

Still, another object of the present invention is to provide an exercise device, wherein the rod, the protrusion means, and the indicator may be positioned on one side of the exercise device, the exercise device may further comprise a second rod, second protrusion means for turning the second rod, and a second indicator adapted to track the number of revolutions of the second rod.

Further, another object of the present invention is to provide an exercise device, wherein the second rod, the second protrusion means, and the second indicator may be laterally spaced from the first rod, the protrusion means and the indicator.

Another object of the present invention is to provide an exercise device, wherein the exercise device may be a treadmill having a front roller and a rear roller, the front roller and the rear roller being substantially parallel, wherein the rods, the protrusion means and the visual indicators may be adapted to change the distance between the front roller and the rear roller.

Further yet, another object of the present invention is to provide an exercise device, wherein the protrusion means may be a knob.

Yet another object of the present invention is to provide an exercise device, wherein the protrusion means may extend outwardly from the frame such that the protrusion means may be turned without an associated tool.

Still, another object of the present invention is to provide an exercise device wherein the protrusion means may extend outwardly from the frame about ½ an inch.

It is yet another object of the present invention is to provide an exercise device, wherein the indicator may further comprise indicia and an indication member adapted to move relative to the indicia.

Yet another object of the present invention is to provide an exercise device, wherein the indicia may be an alphanumeric scale.

Further, another object of the present invention is to provide an exercise device, wherein at least part of the indicator may be digital.

Still another object of the present invention is to provide an exercise device, wherein the exercise device may be a treadmill.

It is yet another object of the present invention to provide a treadmill, which may comprise a frame having a first side rail and a second side rail, wherein the second side rail is oppositely disposed from the first side rail; a front roller; a rear roller; a deck; a belt trained around the front roller and the rear roller, a portion of the belt positioned over the deck; a first belt tensioning mechanism, which may comprise a first rod operatively connected to the first side rail; first protrusion means for turning the first rod; and, a first visual indicator adapted to track the number of revolutions of the first rod; a second belt tensioning mechanism, which may comprise a second rod operatively connected to the second side rail; second protrusion means for turning the second rod; and, a second visual indicator adapted to track the number of revolutions of the second rod.

Another object of the present invention is to provide a treadmill wherein the first belt tensioning device and the second belt tensioning device may be adapted to maintain the rear roller substantially parallel to the front roller.

Still another object of the present invention is to provide a treadmill, wherein the rear roller may be adapted to move laterally relative to the front roller.

Further another object of the present invention is to provide a treadmill, wherein the first protrusion means may be a rotatable knob.

Further yet, another object of the present invention to provide a treadmill, wherein each of the rollers may have an axle passing though a longitudinal axis, the axle having first and second ends, the first end and the second end having a hole defined therein, wherein the first protrusion means and the second protrusion means each comprising a knob having the rod extending therefrom, the rod adapted to pass through the respective holes of the axle.

Yet another object of the present invention to provide a treadmill, wherein the first visual indicator may further comprise indicia and an indication member adapted to move relative to the indicia, the indication member operatively connected to the first end of the axle.

Further, another object of the present invention is to provide a treadmill, wherein the indication member may comprise a substantially horizontal base operatively connected to the first end of the axle; an upwardly extending portion operatively connected to the base; and a substantially horizontal pointer operatively connected to the upwardly extending portion, the horizontal pointer adapted to be visibly located near the indicia.

Another object of the present invention to provide a method for placing tension on a belt of an exercise device, the method may comprise the steps of:

providing a frame having a first side rail and a second side rail, wherein the second side rails is oppositely disposed from the first side rail; a front roller; a rear roller; a deck; a belt trained around the front roller and the rear roller, a portion of the belt positioned over the deck; a first belt tensioning mechanism, comprising: a first rod operatively connected to the first side rail; first protrusion means for turning the first rod; and, a first visual indicator adapted to track the number of revolutions of the first rod; a second belt tensioning mechanism, comprising: a second rod operatively connected to the second side rail; second protrusion means for turning the second rod; and, a second visual indicator adapted to track the number of revolutions of the second rod;

turning the first protrusion means;

moving a first end of the rear roller away from the front roller;

turning the second protrusion means;

moving a second end of the rear roller away from the front roller; and, reading the first visual indicator and the second visual indicator so that a first end and a second end of the rear roller are substantially equidistant from a first end and a second end of the front roller.

It is another object of the present invention to provide a method for placing tension on a belt of an exercise device, which may further comprise the step of turning the first protrusion means and/or the second protrusion means such that the first visual indicator and the second visual indicator show that the rear roller is substantially parallel to the front roller.

Another object of the present invention is to provide a treadmill, which may comprise a frame having a front end and a rear end, and first and second side rails extending longitudinally between the front end and the rear end; a deck operatively connected to the frame; and a belt trained about a front roller and a rear roller, wherein the first side rail has a space defined therein, the space adapted to provide access for maintenance.

Further another object of the present invention is to provide a treadmill which may comprise a wiper assembly operatively connected to the deck, the wiper assembly adapted to pivot relative to the belt such that a wiper selectively contacts an underside of the belt.

Still another object of the present invention is to provide a treadmill, wherein an associated elongated strip may be inserted into the space and then between the deck and the belt so as to spread an associated lubricant between the deck and the belt.

Still yet another object of the present invention is to provide a treadmill wherein the second side rail may have a space defined therein.

Yet another object of the present invention is to provide a treadmill, wherein an associated elongated strip may be inserted into the space and then between the deck and the belt so that to spread a lubricant between the deck and the belt.

Another object of the present invention is to provide a system for maintaining a treadmill, which may comprise a frame having a front end and a rear end, and first and second side rails extending longitudinally between the front end and the rear end; a deck operatively connected to the frame; and a belt trained about a front roller and a rear roller, wherein the first side rail has a space defined therein; and an elongated strip adapted to be inserted into the space and then between the deck and the belt so that to spread a lubricant between the deck and the belt.

Further, another object of the present invention is to provide a system for maintaining a treadmill, wherein the elongated strip may have a length greater than or equal to the width of the belt.

It is yet another object of the present invention is to provide a system for maintaining a treadmill, wherein the frame may further comprise a motor operatively connected to the frame, the motor adapted to move the belt, wherein the elongated strip is adapted to remain in the space and between the deck and the belt while the belt is rotating about the rollers.

Still yet, another object of the present invention is to provide a system for maintaining a treadmill, and may further comprise a wiper assembly operatively connected to the deck, the wiper assembly adapted to pivot relative to the belt such that a wiper selectively contacts an underside of the belt. Another object of the present invention is to provide a method for lubricating a treadmill belt.

Further yet, another object of the present invention is to provide a system for maintaining a treadmill, wherein the space may have a width sized to receive the elongated strip so that the strip can only move in a transverse direction.

Another object of the present invention is to provide a system for maintaining a treadmill, wherein the space may have a width sized to received the elongated strip so that the strip can move in transverse and longitudinal directions.

Another object of the present invention is to provide a method for lubricating a treadmill belt, the method may comprise the steps of:

providing a frame having a front end and a rear end, and first and second side rails extending longitudinally between the front end and the rear end; a deck operatively connected to the frame; and a belt trained about a front roller and a rear roller, wherein the first side rail has a space defined therein; and an elongated strip;

inserting the elongated strip into the space;

positioning the strip between the deck and the belt; and distributing lubricant.

Further, another object of the present invention is to provide a method for lubricating a treadmill belt, wherein the belt has an outer surface, an inner surface, a top run, and a bottom run.

Another object of the present invention is to provide a method for lubricating a treadmill belt, wherein the step of positioning the strip between the deck and the belt may further comprise positioning the strip between the inner surface of the top run of the belt and the deck.

Still yet another object of the present invention is to provide a method for lubricating a treadmill belt, wherein the step of positioning the strip between the deck and the belt may further comprise positioning the strip between the deck and the inner surface of the bottom run.

Yet another object of the present invention is to provide a method for lubricating a treadmill belt, wherein the step of distributing lubricant may further comprise the step of moving the elongated strip along a transverse axis.

Another object of the present invention is to provide a method for lubricating a treadmill belt, wherein the step of distributing lubricant may further comprise the step of moving the elongated strip along a longitudinal axis.

Still another object of the present invention is to provide a method for lubricating a treadmill belt, wherein the treadmill may further comprise a motor operatively connected to the frame to rotate one of the rollers so as to rotate the belt, wherein the step of distributing lubricant may further comprise distributing lubricant by rotating the belt while the motor is operating.

Further another object of the present invention is to provide a method for lubricating a treadmill belt, which may further comprise a wiper assembly operatively connected to the deck, the wiper assembly comprising a wiper blade operatively connected to an elongated member and a handle operatively connected to the elongated member.

Another object of the present invention is to provide a method for lubricating a treadmill belt, which may further comprise the steps of:

pivoting the handle, pivoting the elongated member; and pivoting the wiper blade such that the wiper blade selectively contacts an underside of the belt; and removing debris from the underside of the belt.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
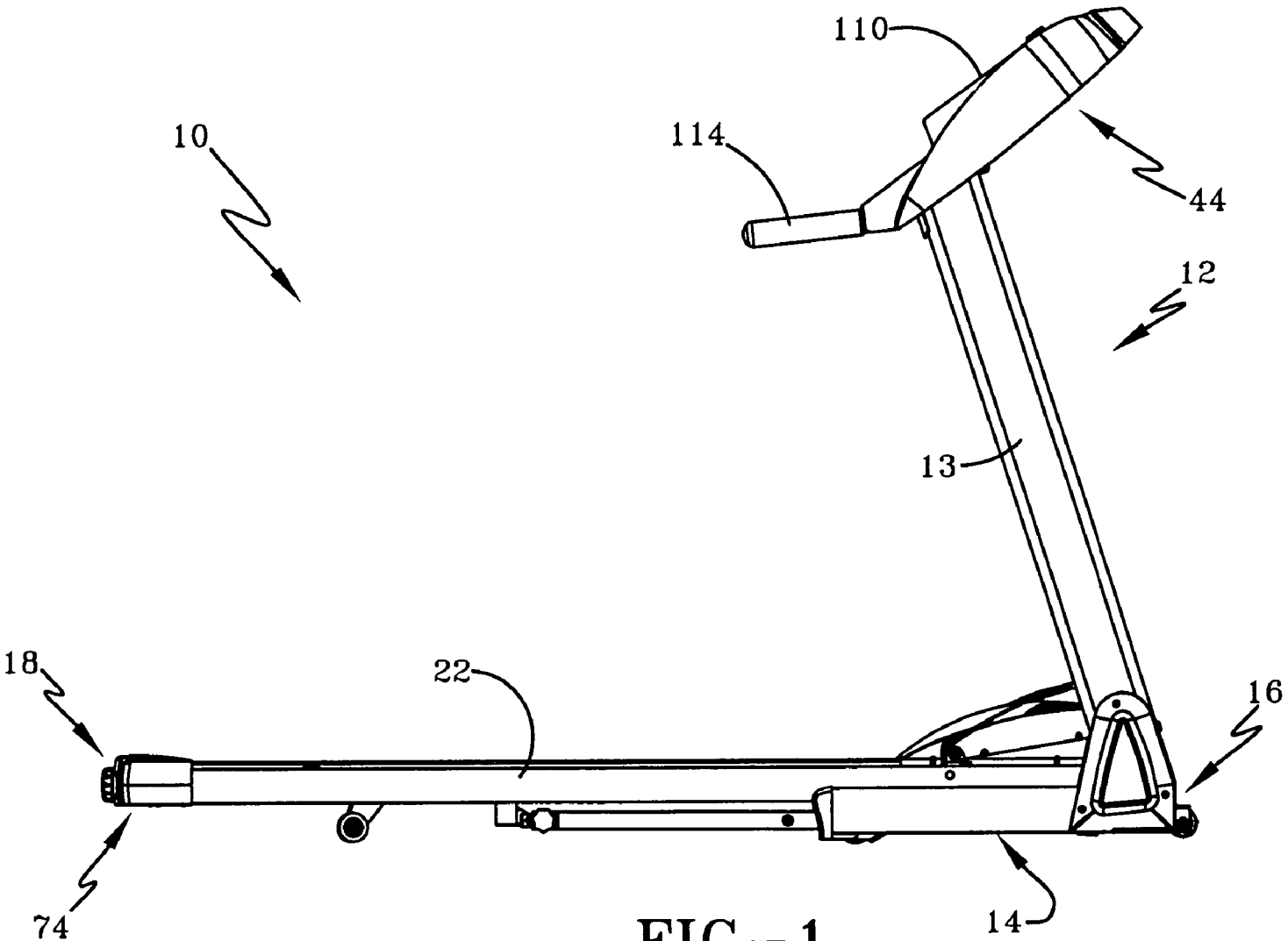
FIG. 1 is a side view of the present invention.

Referring now to the drawings, FIGS. 1-19, wherein the showings are for purposes of illustrating embodiments of the invention only and not for purposes of limiting the same, FIGS. 1, 2, 5, and 12 show various views of an exercise device 10 in the form of a treadmill 12. It is noted that the present invention(s) may be used on any type of exercise equipment which utilizes bells, such as but not limited to a combination treadmill and stepper. The treadmill 12 comprises a frame 14 having a first end 16 and a second end 18. The frame 14 shown includes a first side rail 20 and an oppositely disposed second side rail 22 interconnecting the first end 16 and the second end 18. The treadmill further comprises a front roller 50, having a first end 52 and a second end 54. The front roller 50 may have a hole 56 extending through the front roller's longitudinal axis 58. An axle 60 may be inserted into the hole 56 and connected to the frame 14 so that the front roller 50 may be operatively connected to the frame 14. Further, a rear roller 62 is oppositely disposed and substantially parallel to the front roller 50. The rear roller 62 has a first end 64, a second end 66, and a hole 68 extending along longitudinal axis 70 that receives axle 69. A belt 24 is trained about the front roller 50 and the rear roller 62. The belt 24 has an inner surface 26. and an outer surface 28, a top run 30 and a bottom run 32 The belt 24 is trained about the front roller 50, the second roller 62, and a deck 34 (shown in FIG. 12). The deck 34 is operatively connected to the frame 14 and it has a top surface 36 and a bottom surface 38. The top surface 36 of the deck 34 is adapted to contact or be in close proximity to the inner surface 26 of the top run 30 of the belt 24. At the first end 16 of the treadmill 12, a motor 40 (shown in schematic form in FIG. 5) is utilized to rotate the front roller 50. The motor 40 maybe any motor chosen in accordance with sound engineering judgment. The motor 40 may have a transmission (not shown) in order to adjust the belt 24 speed. The motor 40 may have an output drive shaft 41 and may utilize a drive belt 43 operatively connecting the drive shaft 41 to one of the ends of the axle 60, as shown. As such, rotation of the drive shaft 41 drives and rotates the front roller 50, which in turn rotates the belt 24.

Figure 2:
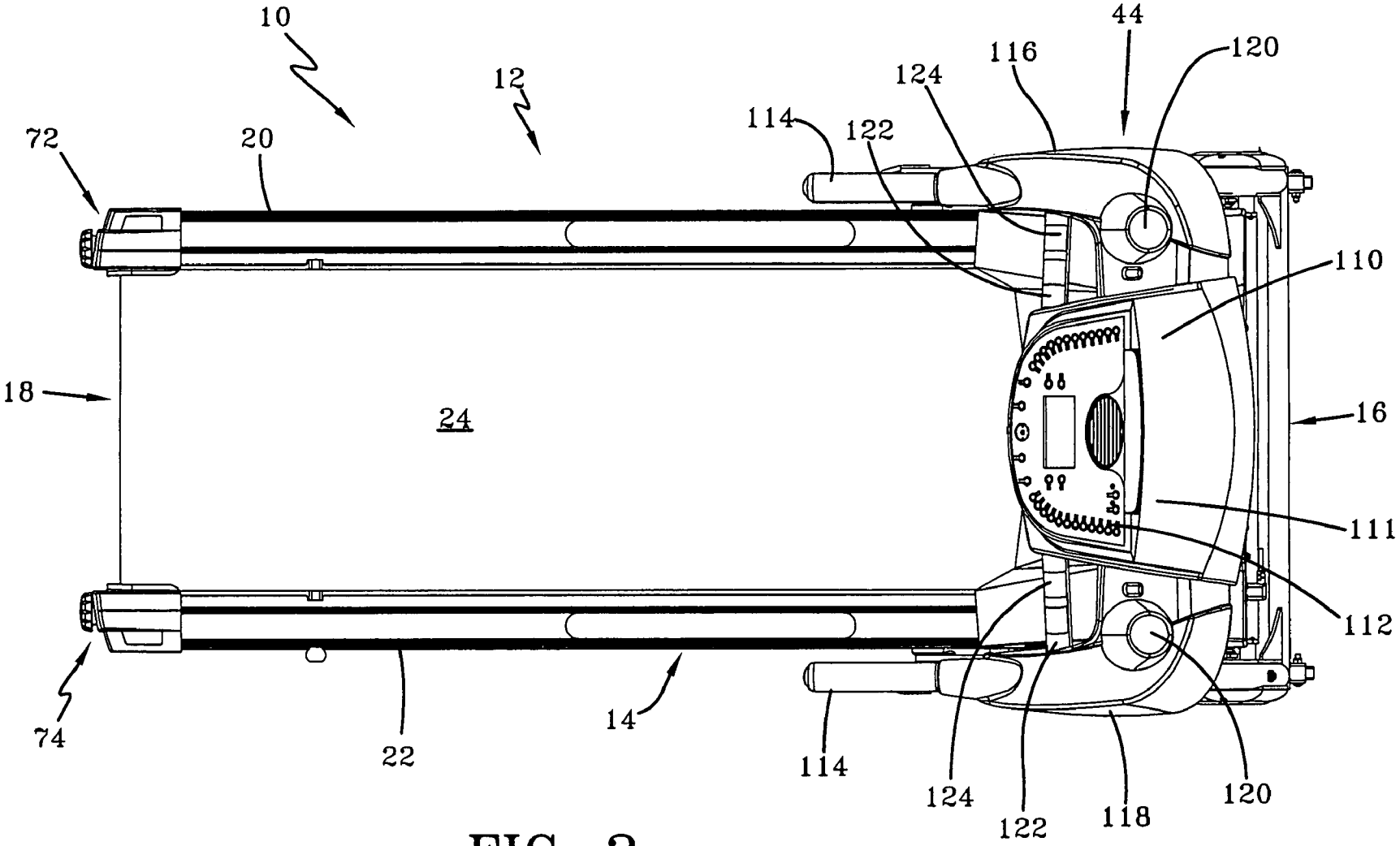
FIG. 2 is a top view of the present invention.
Figure 3:
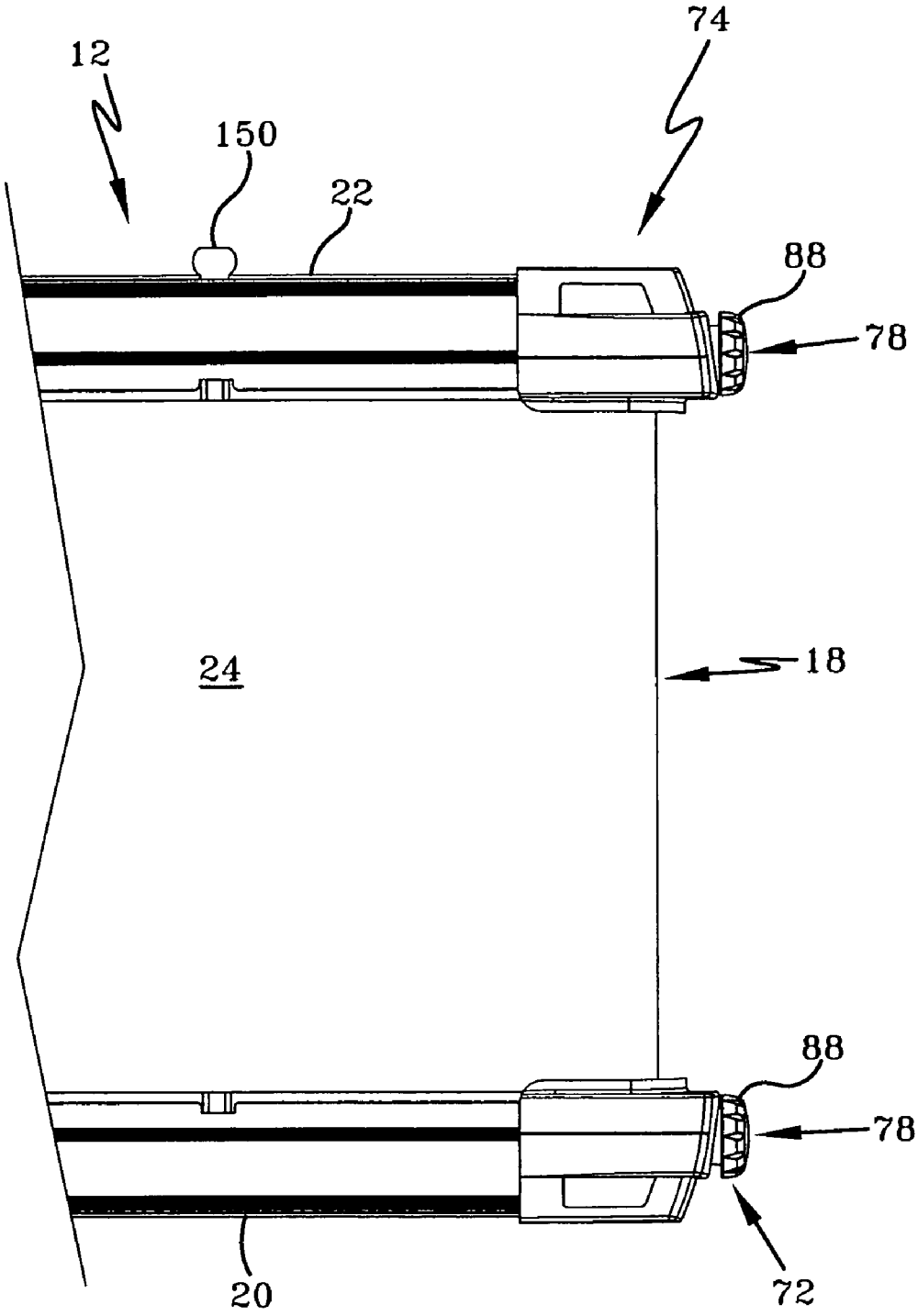
FIG. 3 is a top segmented view of the present invention.
Figure 4:
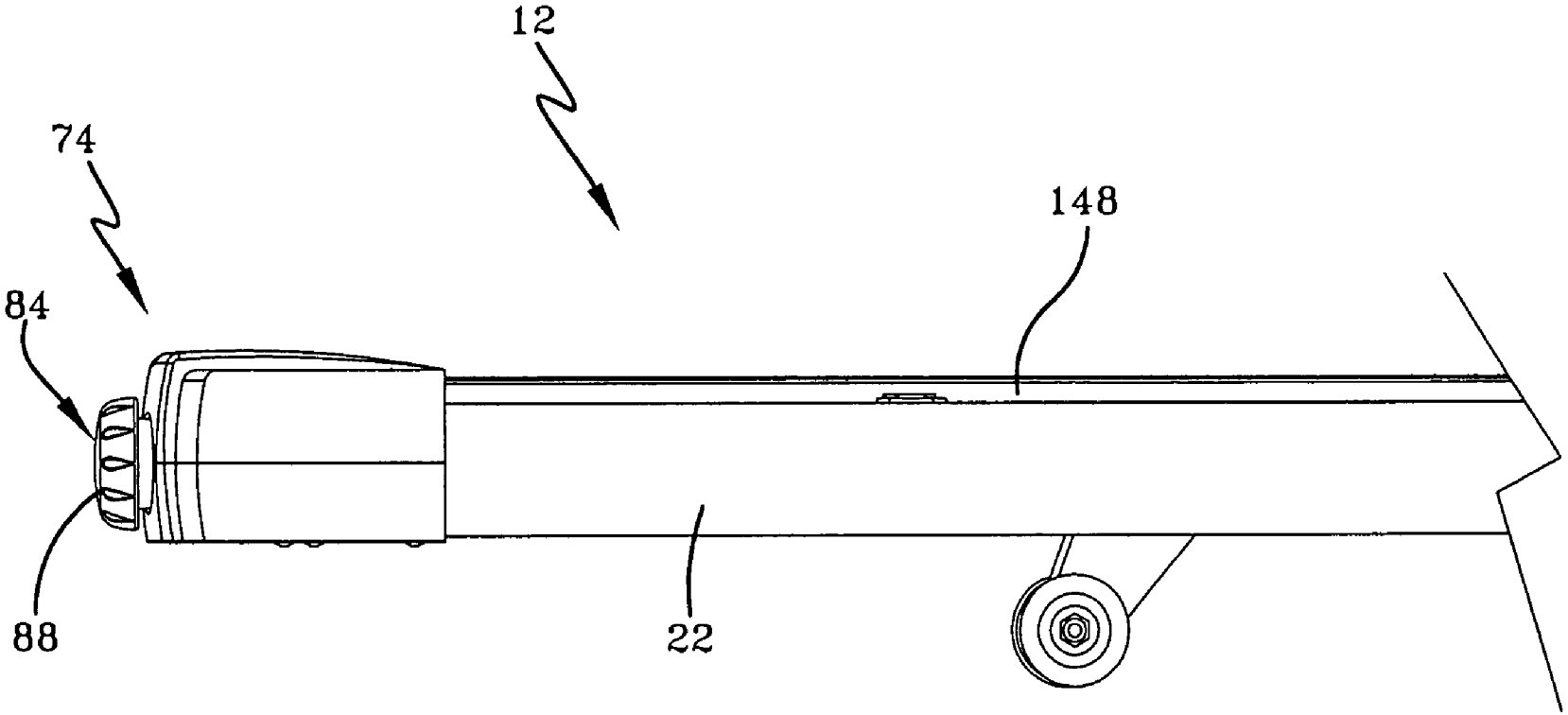
FIG. 4 is a side view of FIG. 3.

With reference now to FIGS. 1 and 2, the first end 16 of the treadmill 12 may include upwardly extending arms 13 which extend from the frame 14 to terminate in a protective shroud 44. The shroud 44 may further comprise a console 110 which contains push buttons 112 for operating various programs while using the treadmill 12. The console 110 may be disposed between a left wing 116 and a right wing 118. Cup holders 120 may also be integrated within the shroud 44. Also, bars 122 may extend outwardly between the console 110 and the left and right wings 116, 118. The treadmill 12 may further comprise two handles 114 operatively connected to the left and right wings 116, 118, which may extend parallel to the deck 34. The length of the handles 114 may be any length chosen with sound engineering judgment, and it is contemplated that they may extend as long as the length of the side rails 20, 22. Electrodes 124 may be provided for use in detecting heart rate, pulse and the like. The electrodes 124 may be mounted to the treadmill 12 in any manner chosen with sound engineering judgment such as by mounting them to one of the bars 122 (as shown) or to one of the handles 114.

Figure 15:
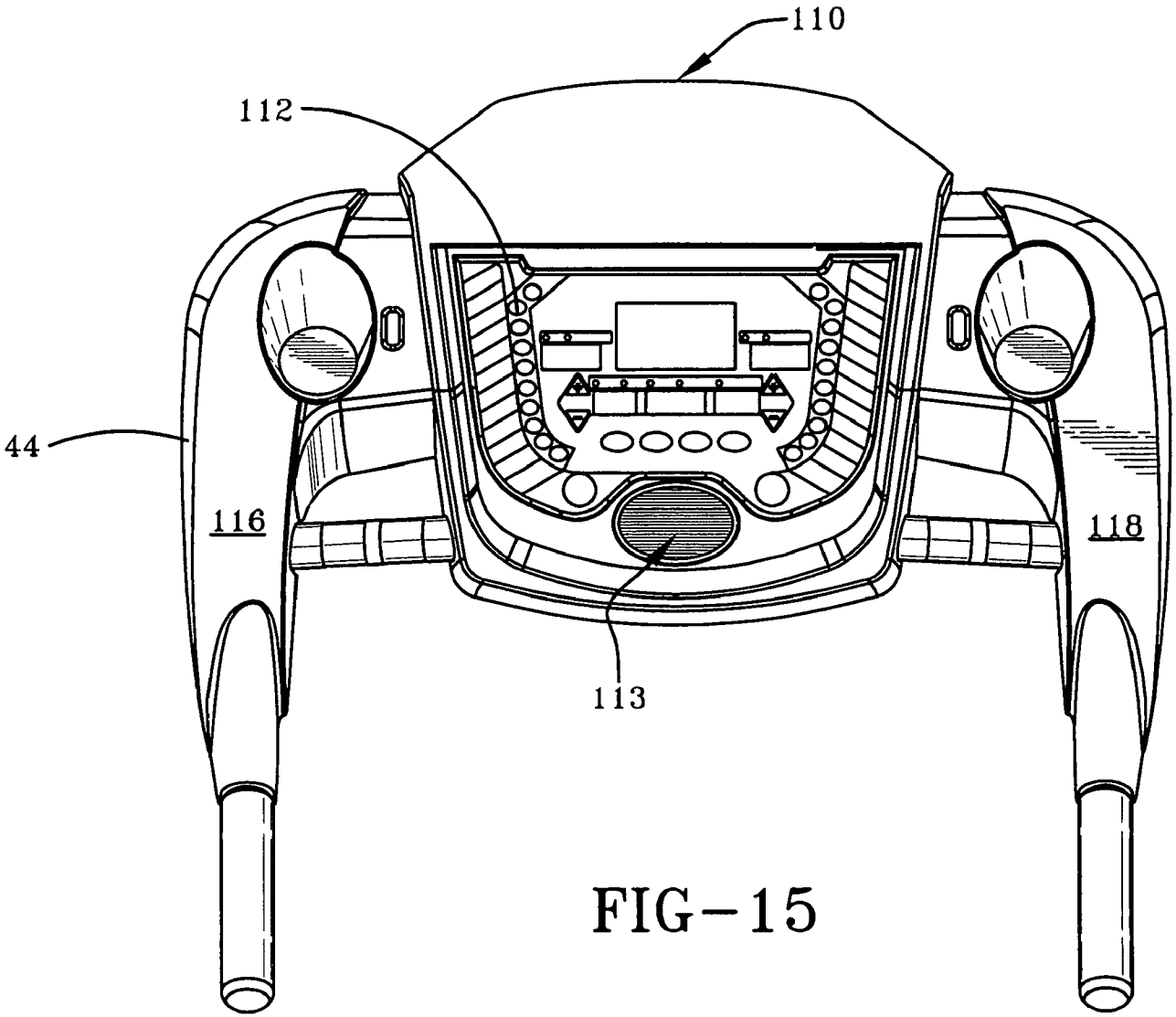
FIG. 15 is an enlarged perspective view of the console.
Figure 16:
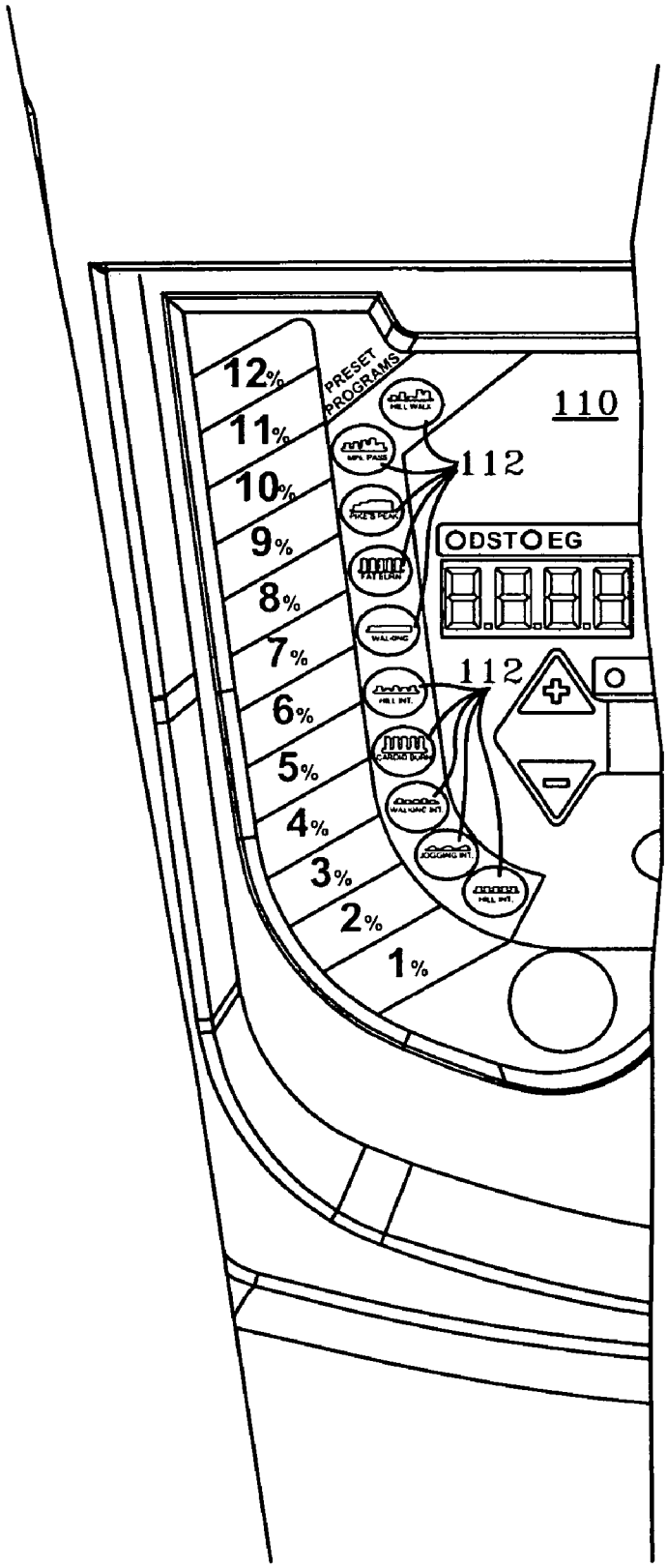
FIG. 16 is an enlarged perspective view of the console.
Figure 17:
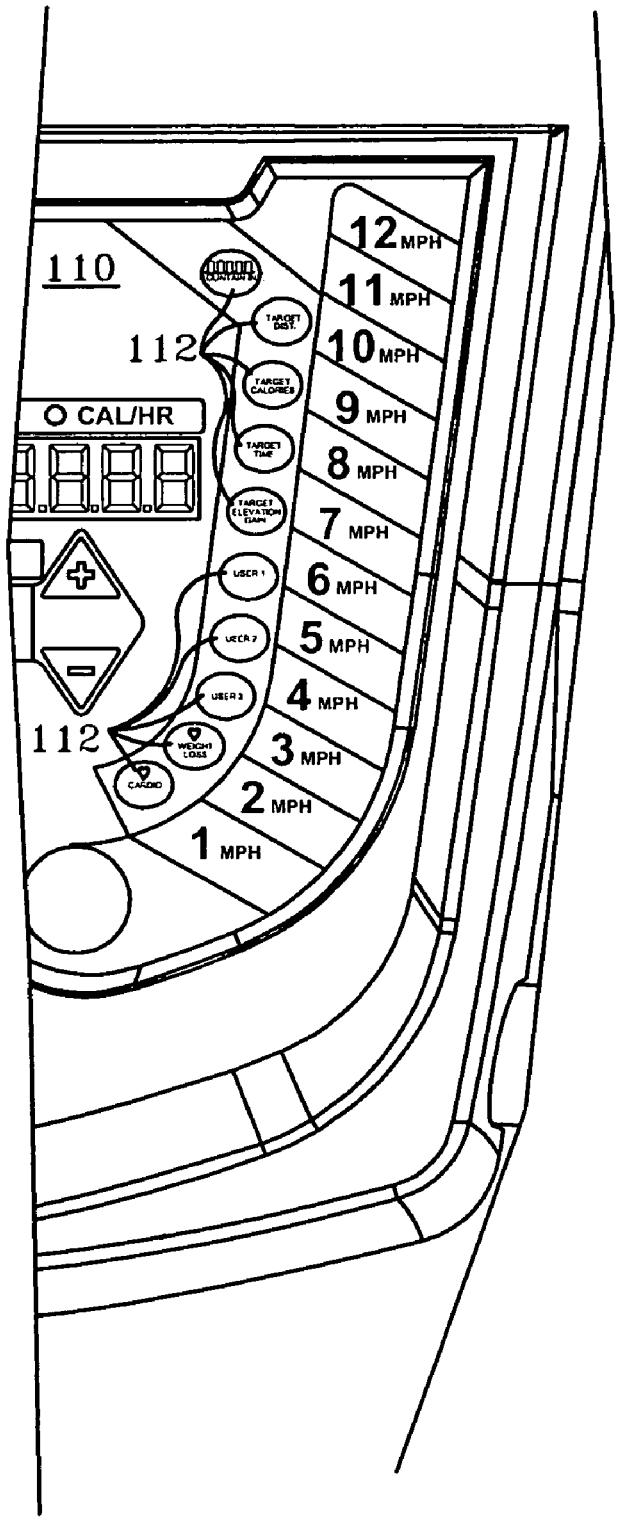
FIG. 17 is an enlarged perspective view of the console.

With continuing reference to FIGS. 1-2 and also to FIGS. 15-17, additional optional features of the console 110 will now be described. The console 110 includes a housing 111, which has the buttons 112 mounted thereon. The buttons 112 electrically communicate with a circuit board (not shown). The circuit board activates the motor 40 (illustrated in FIG. 5) in order to move the belt 24 as described above. The console 110 may comprise an incline gradation from one percent (1%) to twelve percent (12%) although other incline graduations chosen with sound engineering judgment can also be used. Similarly, the speed may range from one mile per hour to twelve miles per hour although other speeds and speed ranges chosen with sound engineering judgment can also be used. Various program keys are also included such that the user can push a button one time in order to achieve a desired workout. These may include, but are not limited to, a hill walk, a mountain pass, pike's peak, fat burning, walking, jogging, cardio burn, walking intensity, jogging intensity, hill intensity, and mountain intensity. Other push buttons may include target distance, target calories, target time, target elevation gain, pre-programmed user buttons, a weight loss button, and a cardio button. A fan 113 may be included on the console 110.

With reference now to FIGS. 3-8, a first belt tension mechanism 72 and a second belt tension mechanism 74 are shown. Having a mechanism to adjust belt tension results in longer treadmill belt life, and therefore, is often desirable. Over time, the belt 24 stretches as a user walks, jogs, or runs on it at various speeds and under various loads. As such, the belt may stretch and the extra slack needs to be accounted for. In order to increase tension on the belt 24, the distance between the rear roller 62 and the front roller 50 should be increased, in order to place appropriate tension on the belt 24. It is contemplated to be within the scope of the present invention to adjust either the rear roller, 62, the front roller 50, or both rollers. In one embodiment of the present invention, the first belt tension mechanism 72 comprises a first rod 76 operatively connected to the frame 14, which may be at the first side rail 20, first protrusion means 78 for turning the first rod 76 and a first indicator 80 adapted to track the number of revolutions of the first rod 76. Further, the second belt tension mechanism 74 comprises a second rod 82, second protrusion means 84, and a second indicator 86, which is configured similarly of the first belt tension mechanism 72.

The first and second belt tension mechanisms 72, 74 offer several advantages. First, the first and second protrusion means 78, 84 enables the user to adjust the first rod 76 and the second rod 82 without the use of a tool. As such, tools are not lost and the mechanisms 72, 74 are easy to adjust. Further, the first indicator 80 and the second indicator 86 enable the user to easily identify whether or not the first and second ends 64, 66 of the rear roller 62 have been moved the same distance relative to the front roller 50. By enabling the user to easily identify the position of the rear roller 62, meaning if it is substantially parallel to the front roller 50, belt tension is even, which results in even wear and prolongs belt life.

With continuing reference to FIGS. 3-8, the first rod 76, the first protrusion means 78 and the first indicator 80 may be positioned on one side of the treadmill 12 adjacent to the first side rail 20. Similarly, the second belt tension mechanism 74 including the second rod 82, the second protrusion means 84 and the second indictor 86 may be disposed adjacent to the second side rail 22. As shown in the FIGURES, the first and second protrusion means 78, 84 may take the form of a knob 88. Generally, a knob is easy for a user to grasp and rotate. Of course, any protrusion chosen with sound engineer judgment may be chosen, such as a bar, a ratchet or other similar mechanism. Any protrusion configuration which extends outwardly from the treadmill 12 may be utilized. In one embodiment, the protrusion means 78, 84 may extend about ¼ inch to about 1½ inches outwardly past the second end 18 of the treadmill 12.

Figure 5:
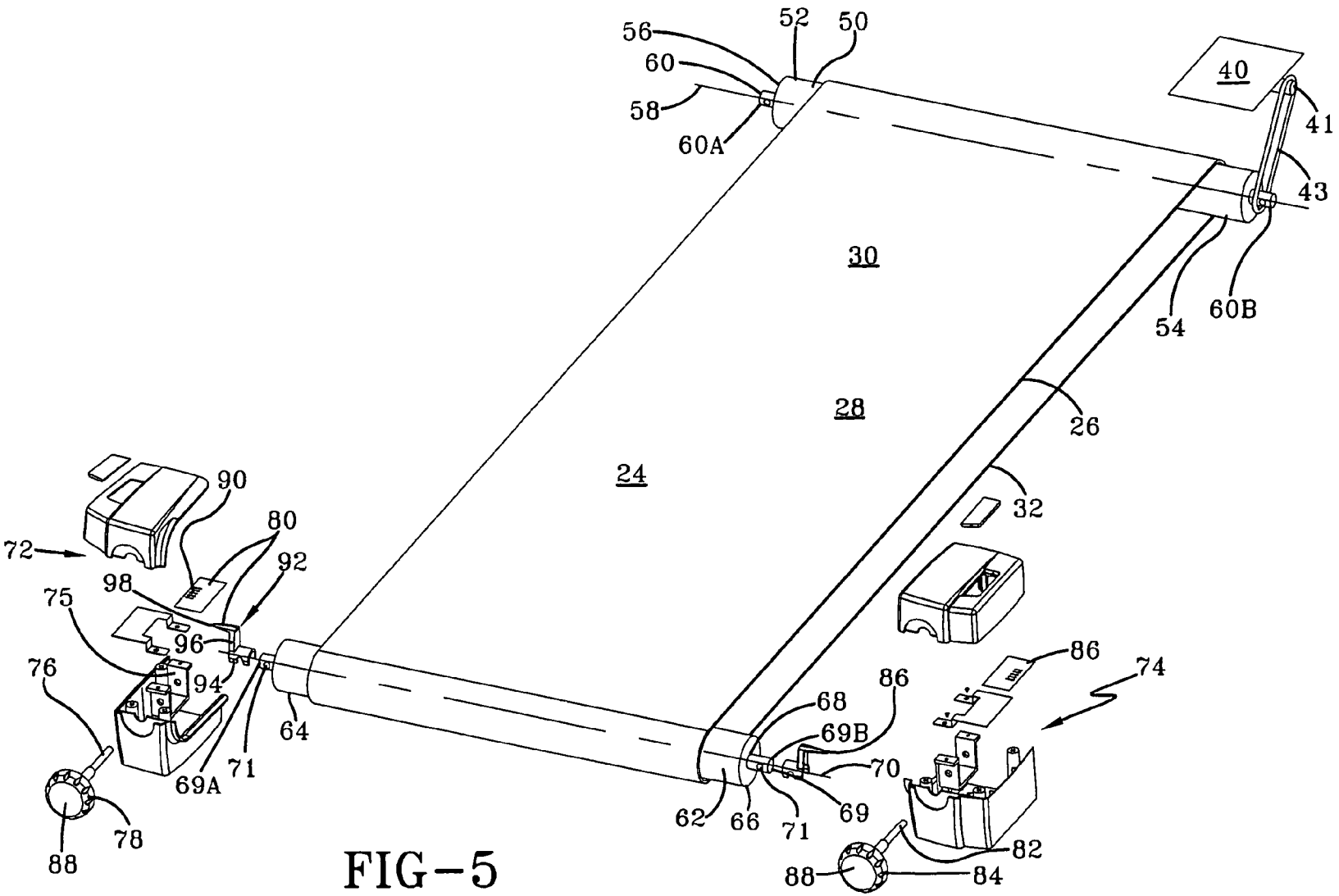
FIG. 5 is exploded perspective view of one feature of the present invention.
Figure 6:
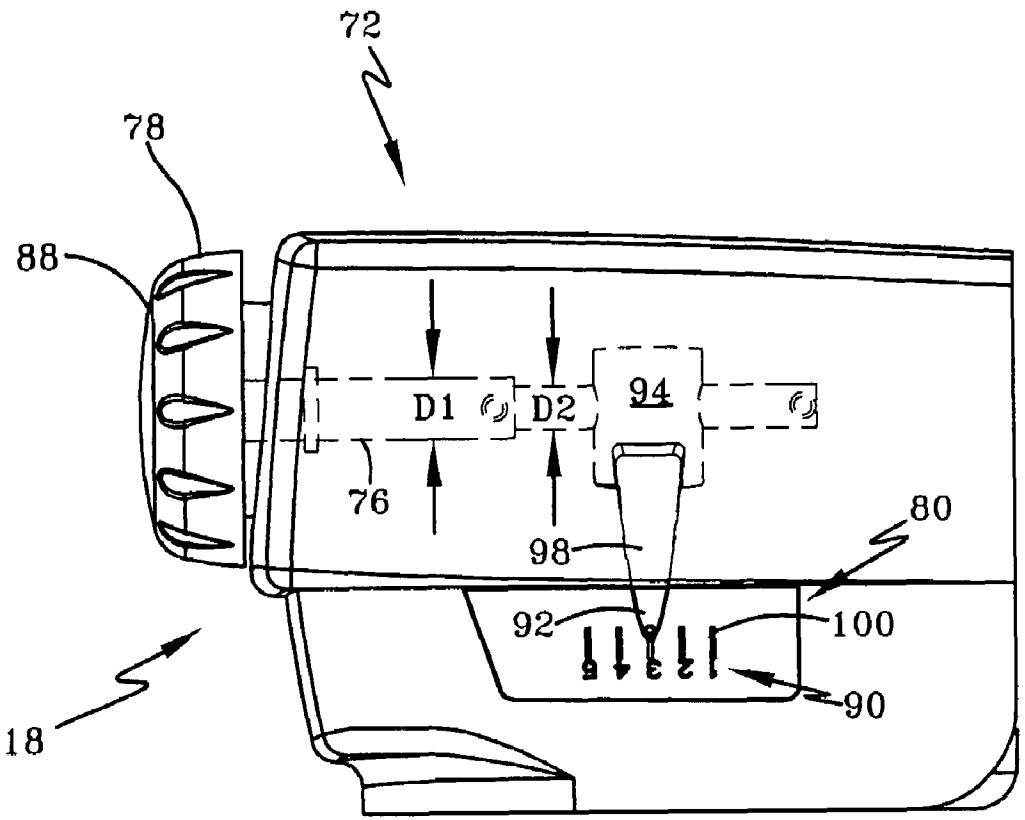
FIG. 6 is top view of one feature of the present invention.
Figure 7:
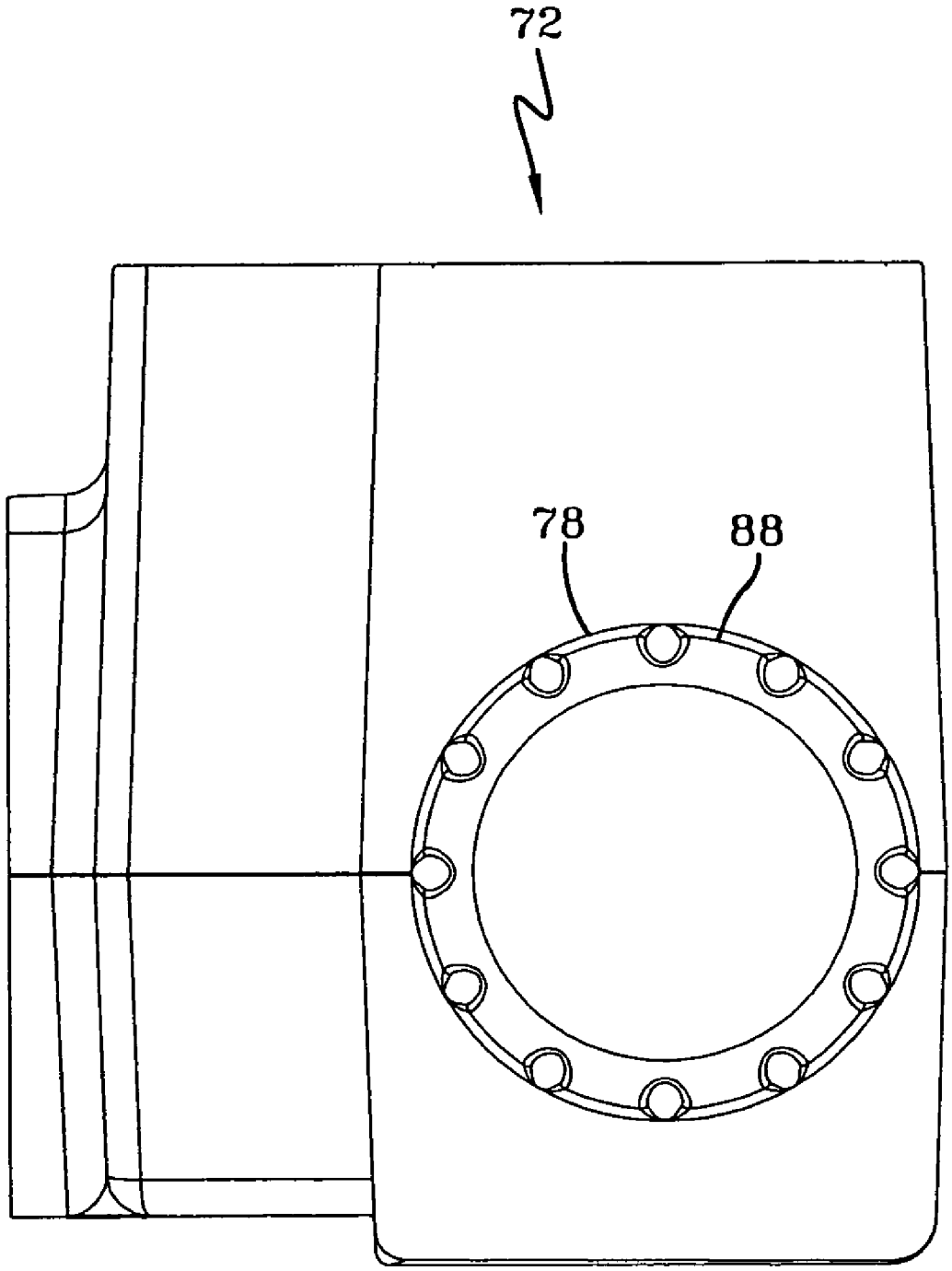
FIG. 7 is a left elevational view of FIG. 6.
Figure 8:
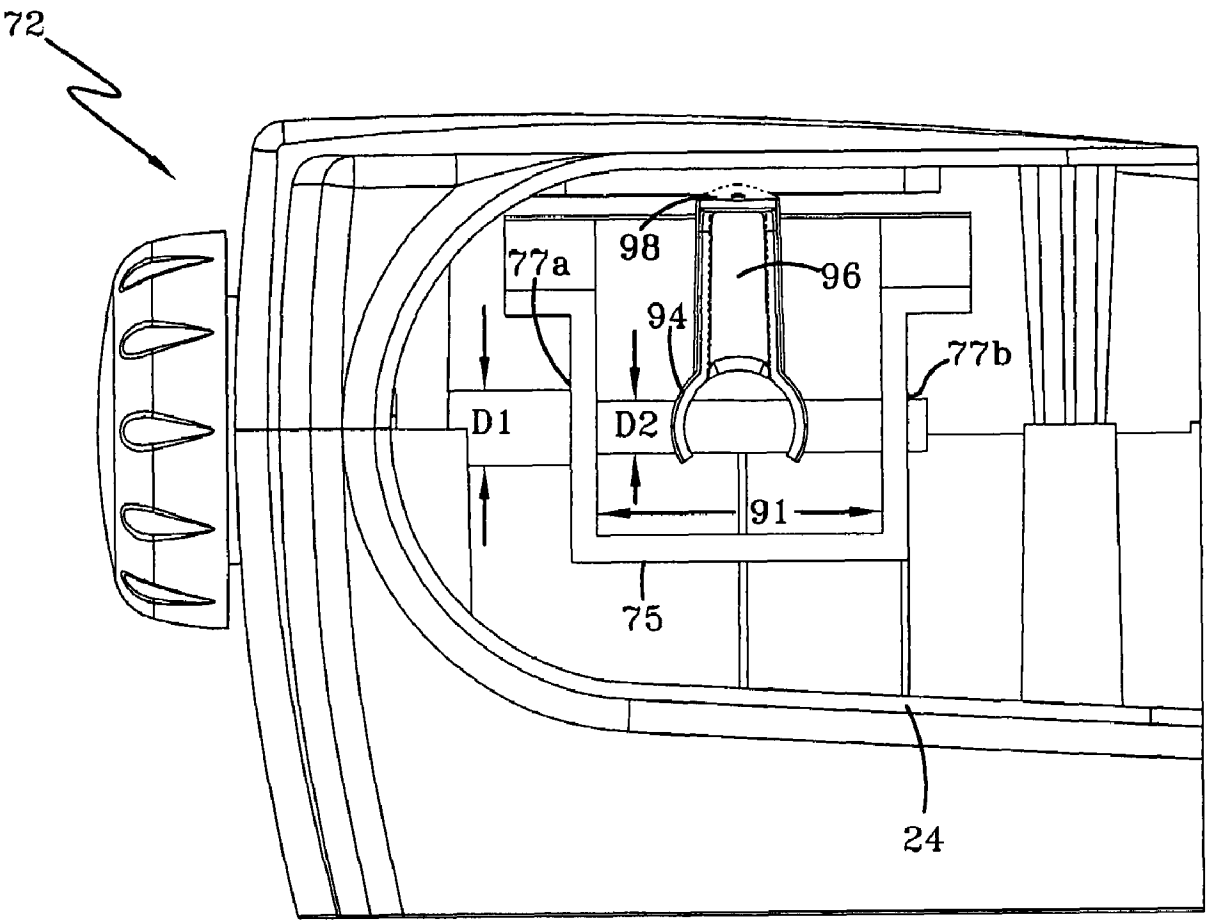
FIG. 8 is a cross-sectional view of FIG. 6.
Figure 9:
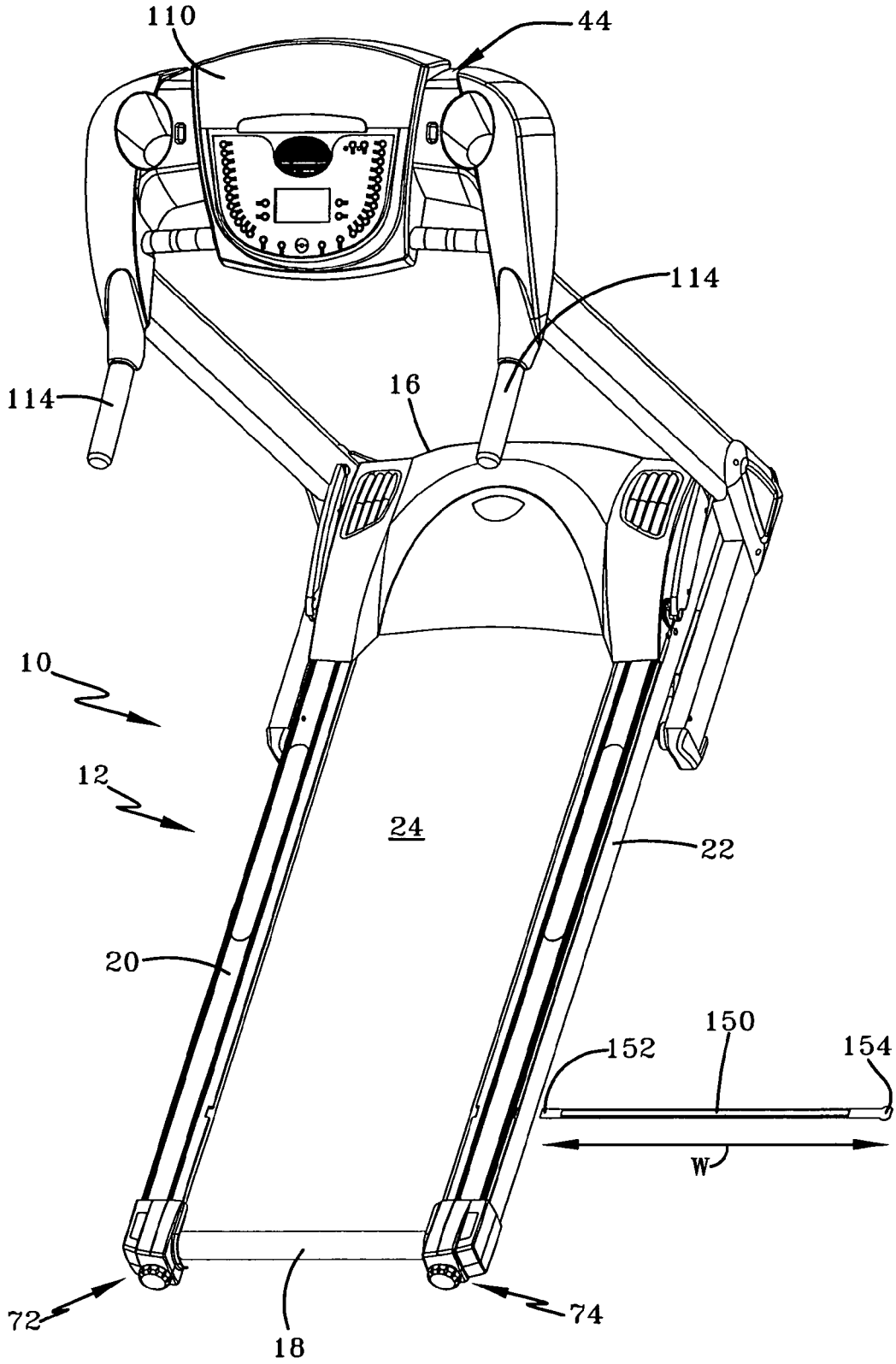
FIG. 9 is a top perspective view of the present invention.
Figure 10:
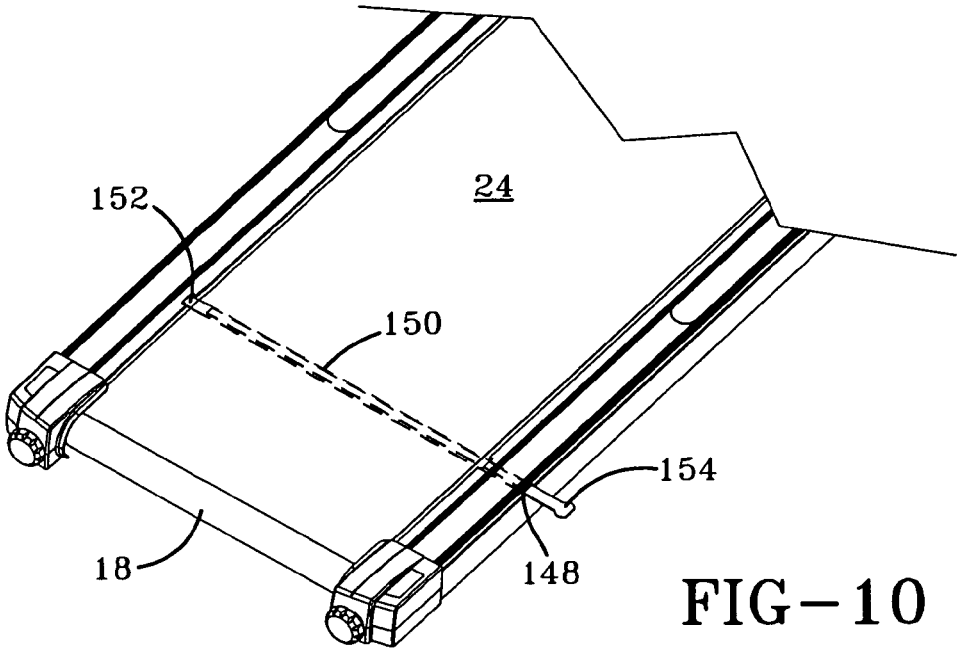
FIG. 10 is a segmented perspective view of the present invention.
Figure 11:
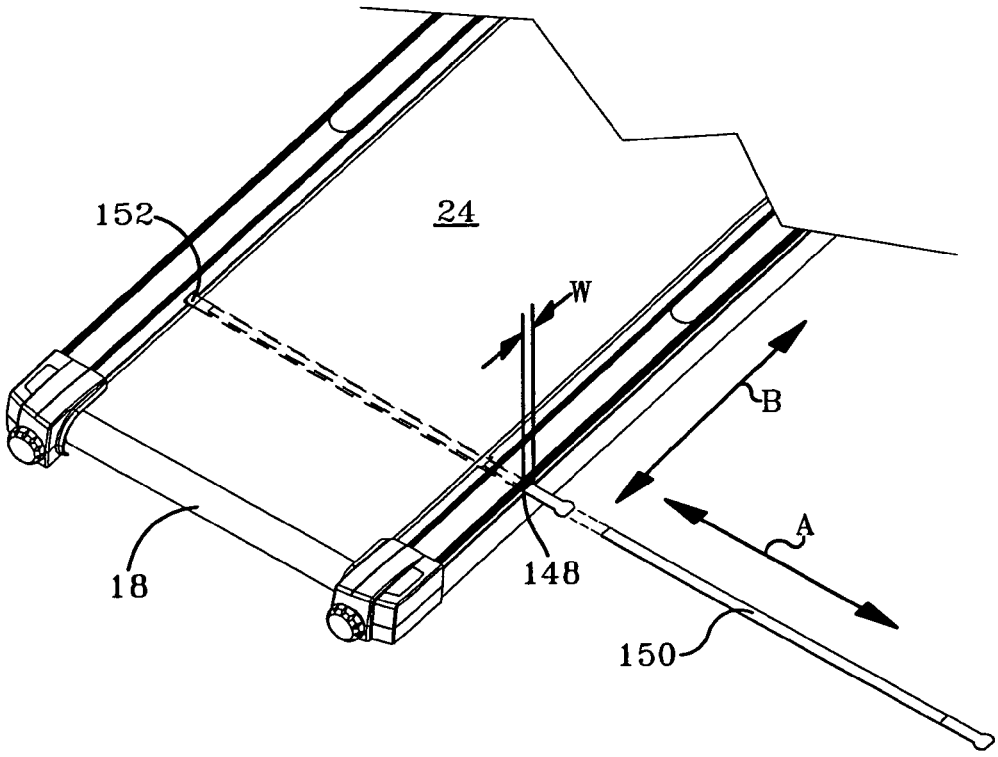
FIG. 11 is another segmented perspective view of the present invention.
Figure 12:
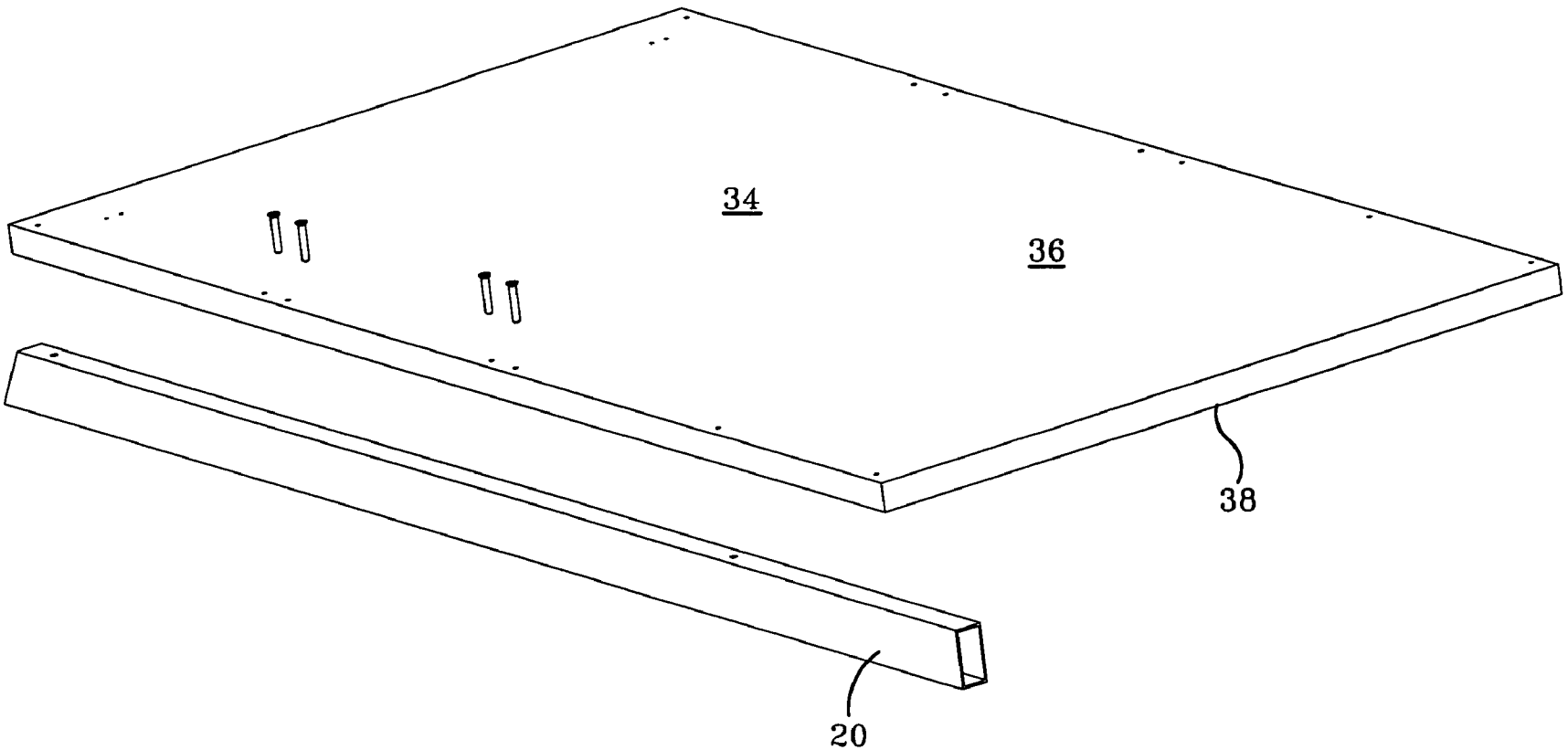
FIG. 12 is an exploded perspective view of one feature of the present invention.
Figure 13:
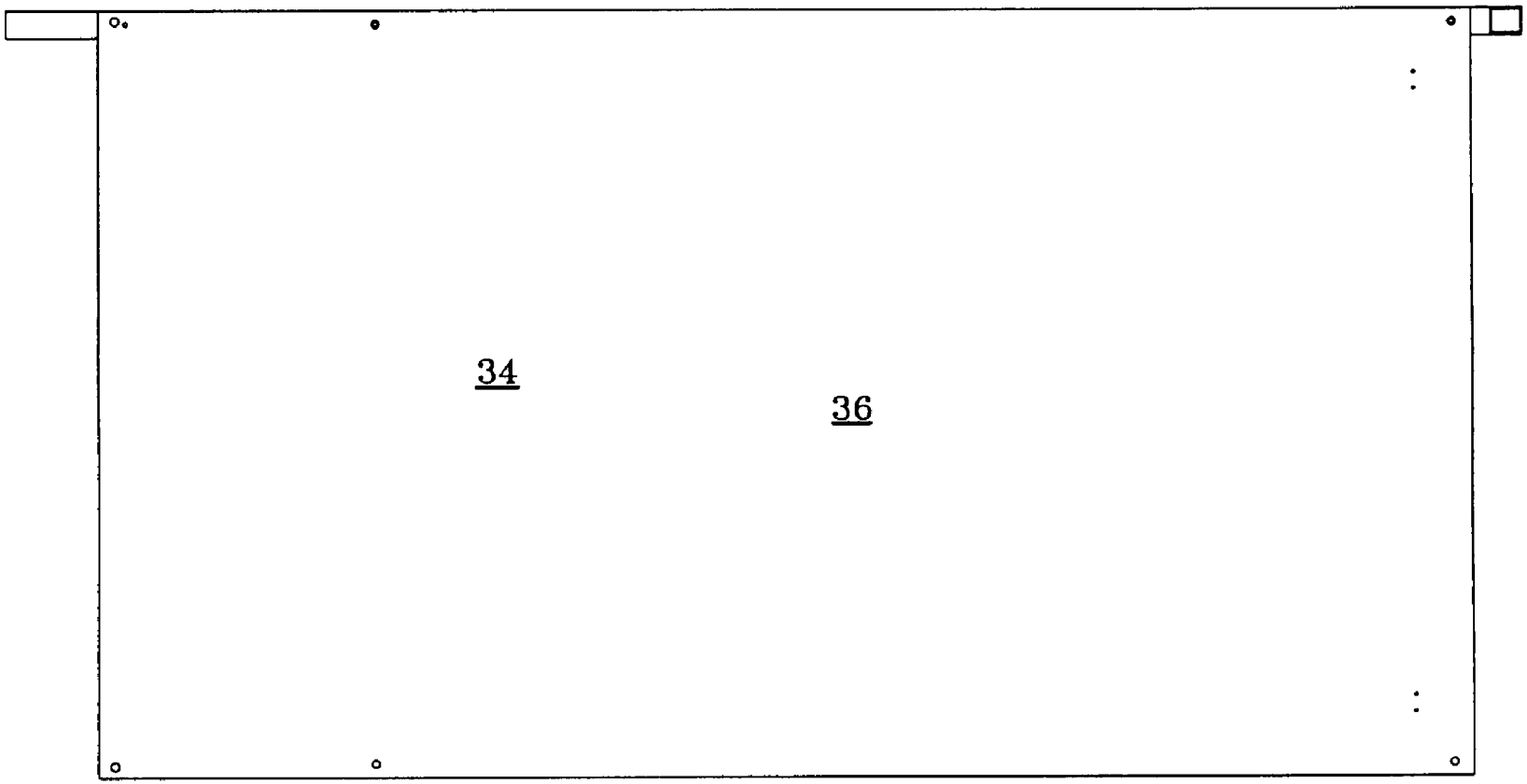
FIG. 13 is a top view of another feature of the present invention.
Figure 14:
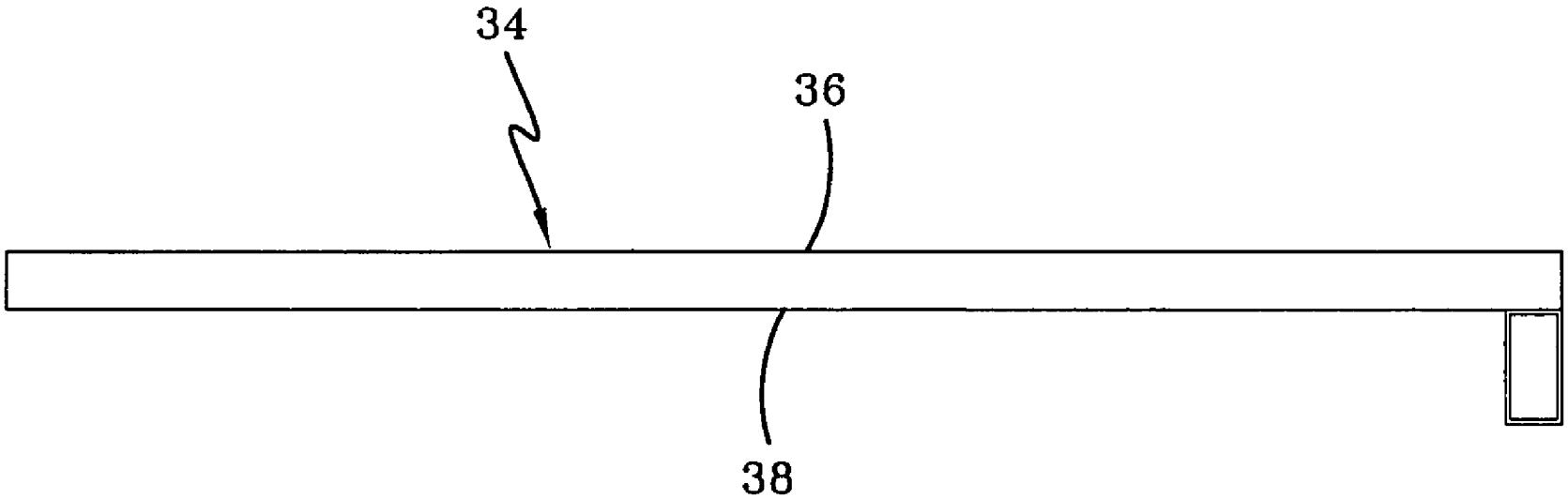
FIG. 14 is an elevational view of FIG. 13.

Still referring to FIGS. 3-8, the first indicator 80 may comprise indicia 90 and an indication member 92. The indication member 92 may be operatively connected to a first end 69A of the rear roller axle 69 and may be adapted to move relative to the indicia 90, as shown. In one embodiment of the present invention, the indicia 90 may be an alpha-numeric scale. In another embodiment of the present invention, the indicia 90 may be digital and could include an LCD display. The indication member 92 may comprise a substantially horizontal base 94 and an upwardly extending portion 96 attached thereto. A horizontal pointer 98 may be attached to the upwardly extending portion 96. The horizontal pointer 98 is adapted to move proximate the indicia 90 (the alpha-numeric scale, for example) as the protrusion means 78 is moved. The second indicator 86 may be similarly designed. As shown in FIG. 5, each of the rollers 50, 62 has an axle 60, 69, and each axle 60, 69 has first ends and second ends 60A, 60B, 69A 69B. The axle 69 of the rear roller has a pair of holes 71, 71 defined in the first and second ends 69A, 69B. In one embodiment the holes 71, 71 are threaded. The first rod 76 and the second rod 82 pass through the holes 71, 71 defined in the rear roller axle 69. A U-shaped bracket 75 (shown in FIGS. 5 and 8) may be attached to the first side rail 20 (shown in FIG. 3) and may have a pair of holes 77*a*, 77*b* (shown in FIG. 5 and referenced in FIG. 8). The first rod 76 of the first belt tension mechanism 72 extends through the hole 77*a*, through the hole 71 in axle 69 (near the first end 64 of the rear roller 62) and then through the hole 77*b*, as shown. In one embodiment, the first rod 76 has a first portion with a first diameter D1 and a second portion with a diameter D2, wherein D2 is less than D1. The U-shaped bracket 75 may define a cavity 91. The axle 69 can thus move along the axis of the first rod 76 (in a longitudinal direction with respect to the treadmill 12) within the cavity 91 in order to adjust belt tension. Further, the portion of the rod 76 having diameter D1 may be threaded to engage the threaded holes 71 of the rear axle 69. It should be understood that the second rod 82 of the second belt tension mechanism 74 is similarly constructed and operated.

Operation of the belt tension mechanisms 72, 74 will now be described. Upon detection of slack in the belt 34, the user turns the first protrusion means 78. This moves the first end 64 of the rear roller 62 away from the first end 52 of the front roller. Next, the operator turns the second protrusion means 84. This moves the second end 66 of the rear roller 62 away from the second end 54 of the front roller 50. The user reads the first visual indicator 80 and compares it with the reading of the second visual indicator 86. This ensures that the first end 64 and the second end 66 of the rear roller 62 are substantially equal distance from the first end 52 and the second end 54 respectively of the front roller 50. If the first and second visual indictors 80, 86 have the same reading, the belt 24 is being pulled in tension evenly across its width. However, if the first and second visual indicators 80, 86 are different, the first and/or second protrusion means 78, 84 may be again rotated until the indication means the visual first and second visual indicators 80, 86 have the same reading.

With reference now to FIGS. 5 and 9-14, another feature of the present invention is described. As previously stated, the treadmill frame 14 has a first side rail 20 and second side rail 22 extending longitudinally between the first end 16 and the second end 18 of the treadmill 12. In one embodiment of the present invention, the first side rail 20 has a space 148 defined therein, which is adapted to provide access for maintenance. On occasion, the inner surface 26 of the belt 24 should be cleaned and lubricated to decrease the amount of friction between the top surface 36 of the deck 34 and the inner surface 26 of the top run 30 belt 24. This reduces undo wear of the treadmill belt 24.

In the embodiment of the present invention shown in FIGS. 9-14, an elongated strip 150 may be inserted into the space 148 of the first side rail 20. The elongated strip 150 may have a first end 152 and a second end 154. The second end 154 may be inserted between the deck 34 and the belt 24 in order to spread lubricant between the deck 34 and the belt 24. It is also contemplated in another embodiment of the present invention that the second side rail 22 may also have a similar space 148 defined therein. In one embodiment of the present invention, the elongated strip 150 has a length greater than or equal to the width of the belt 24. It is also contemplated that the motor 40 move the belt 24 while the elongated strip 150 is disposed between the belt 24 and the deck 34. The rotation of the belt 24 enables distribution of the lubricant.

The space 148 may be any size chosen in accordance with engineering judgment. The space defined in the side rails 20, 22 of the frame 14 may take any form chosen in accordance with sound engineering judgment, including, but not limited to a notch, a hole, or a groove. This alleviates the need for pulling and twisting the belt 24 in order to place lubricant under the belt 24. However, it is also contemplated that the side rails 20, 24 may be configured such that the space 148 is located between the top of either (or both) side rails 20, 22 and the deck 34. In one embodiment, the space 148 has a width W substantially the same size as the width of the strip 150 to therefore receive the strip 150 yet limit the motion of the strip 150 to the transverse direction, shown by arrow A. In another embodiment of the present invention, the width W of the space 148 is large enough to receive the elongated strip 150 so that the strip can move in transverse direction A as well as the longitudinal direction, shown by arrow B. This space width W impacts the speed of lubricating the belt 24.

In order to use this feature of the present invention, the elongated strip 150 of the treadmill 12 as described herein is provided. The elongated strip 150 is inserted into the space 148. The strip 150 is thus positioned between the deck 34 and the belt 24. The user then distributes the lubricant. When positioning the elongated strip 150 between the deck 34 and the belt 24, the elongated strip 150 may be disposed between the inner surface 26 of the top run 30 of the belt 24 and the top surface 36 of the deck 34. Alternatively, the space 148 may be positioned lower on the rail 20 and thus the elongated strip 150 may be disposed between the bottom surface 38 of the deck 34 and inner surface 26 of the bottom run 32 of the belt 24. As explained above, depending upon the size of the space 148, the elongated strip maybe moved transversely (arrow A) and/or longitudinally (arrow B). As previously described, the motor 40 may rotate one of the rollers 50, 62 to rotate the belt 24. As such, the step of distributing lubricant may further include distribution of the lubricant by rotating the belt 24 while the motor 40 is operating.

Figure 18:
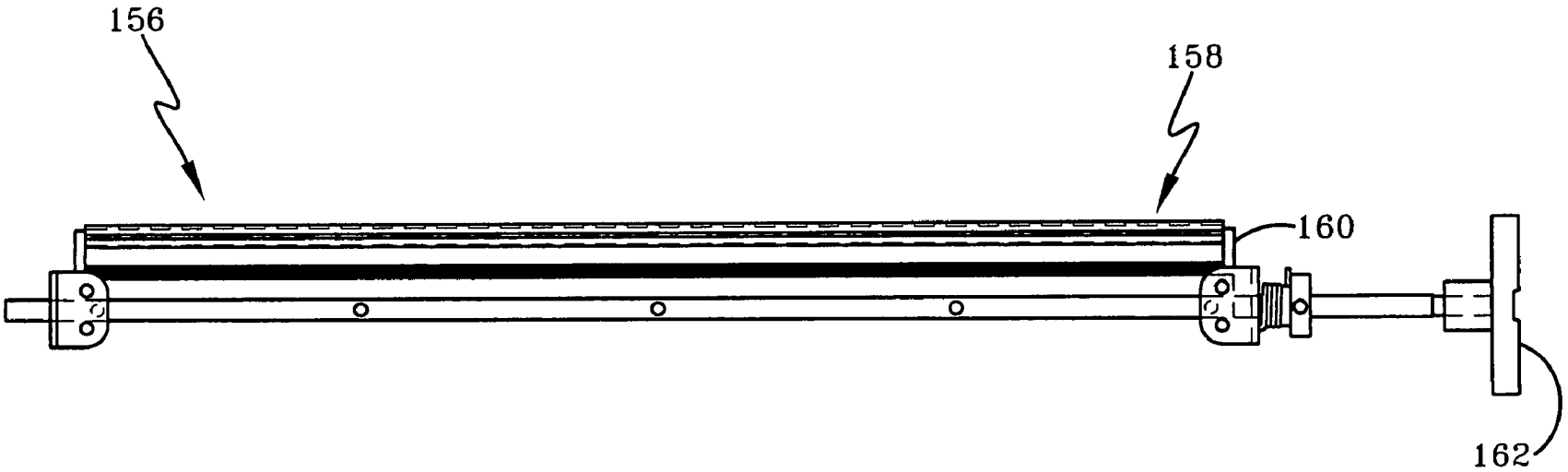
FIG. 18 is a front elevational view of the wiper assembly.
Figure 19:
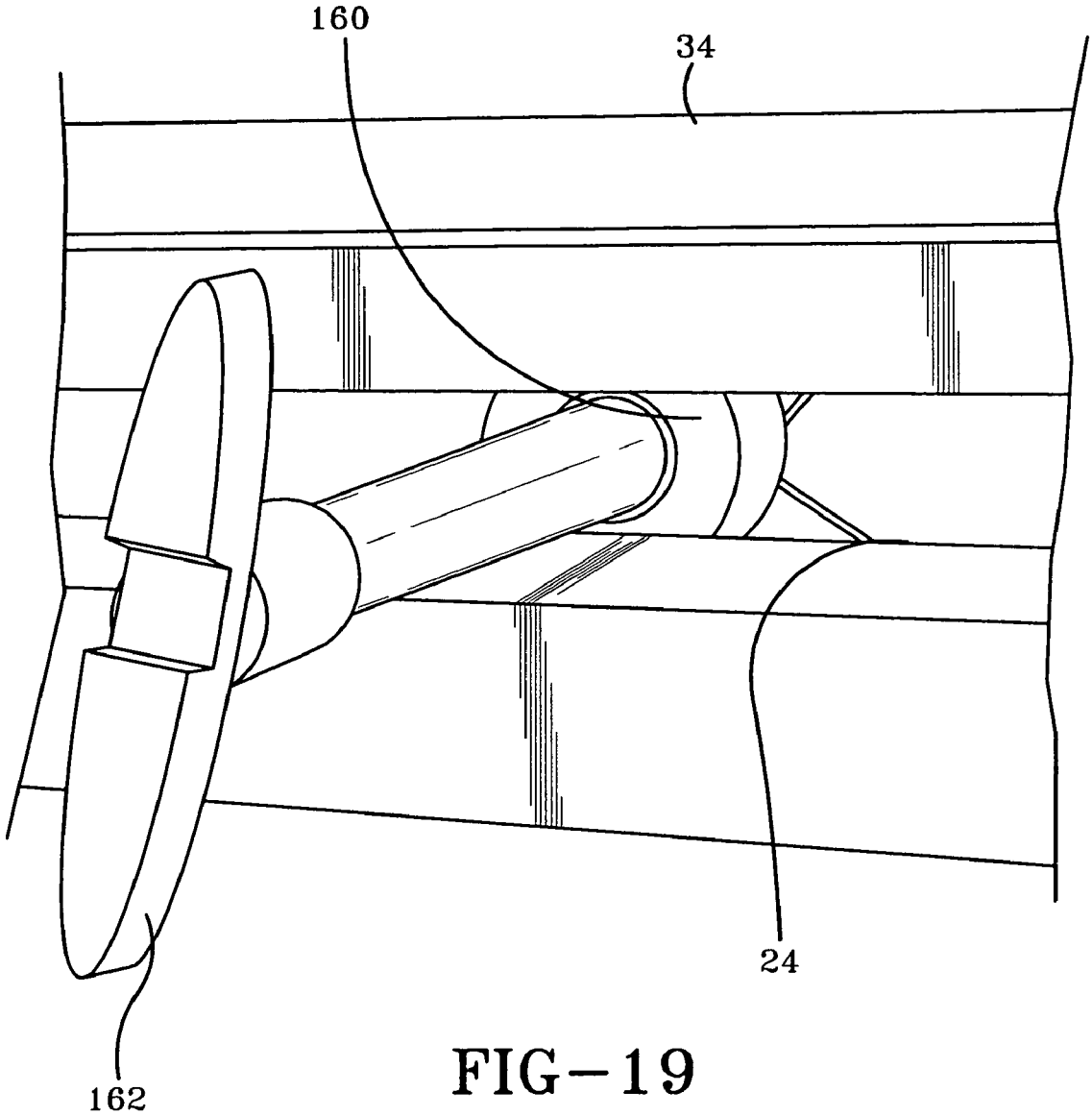
FIG. 19 is a perspective view of the wiper assembly.

With reference now to FIGS. 18 and 19, another embodiment of the present invention is shown. A wiper assembly 156 is provided and is operatively connected to the treadmill 12. The wiper assembly 156 is adapted to selectively contact the inner surface 26 of belt 24 to remove debris therefrom and/or to spread lubricant thereon. The wiper assembly 156 may include a wiper blade 158 operatively connected to an elongated member 160. The wiper blade 158 may be selectively positionable between a first contact position where the wiper blade 158 contacts the inner surface 26 of the belt 24 and a second no-contact position where the wiper blade 158 does not contact the inner surface 26 of the belt 24. The mechanism used to adjust the wiper blade 158 between the first and second positions can be any chosen with sound engineering judgment. In one embodiment, one or more springs (such as torsion springs) may be used to bias the wiper blade 158 into the second non-contact position. When desired, the wiper blade 158 can then be placed into the first contact position by turning or rotating a handle 162 connected to the elongated member 160 and thereby overcome the biasing force of the spring(s). In another embodiment, the wiper blade 158 may simply be adjusted vertically between the first and second positions. With this embodiment no rotational movement and no springs are required. It should be noted that it is contemplated to use a permanent wiper blade 158 and, alternatively, to use replaceable wiper blades 158.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A treadmill, comprising:

a frame having a first side rail and a second side rail, wherein said second side rail is oppositely disposed from said first side rail;

a front roller and a rear roller operatively connected to said frame;

a deck operatively connected to said frame;

a belt trained around said front roller and said rear roller;

a first belt tensioning mechanism, comprising:

a first rod operatively connected to one side of said belt;

first protrusion means for turning said first rod; and, a first visual indicator adapted to track the number of revolutions of said first rod;

a second belt tensioning mechanism comprising:

a second rod operatively connected to the opposite side of said belt;

second protrusion means for turning said second rod; and, a second visual indicator adapted to track the number of revolutions of said second rod; wherein each of said rear rollers has an axle passing though a longitudinal axis, said axle having first and second ends, said first end and said second end having a hole defined therein, wherein said first protrusion means and said second protrusion means each comprising a knob having said rod extending therefrom, said rod adapted to pass through said respective holes of said axle such that rotation of said first rod moves said first end of said axle, said first visual indicator further comprises indicia; and an indication member adapted to move relative to said indicia, said indication member operatively connected to said first end of said axle.

2. The treadmill of claim 1, wherein said first belt tensioning device and said second belt tensioning device are adapted to maintain said rear roller substantially parallel to said front roller.

3. The treadmill of claim 1, wherein said rear roller is adapted to move longitudinally relative to said front roller.

4. The treadmill of claim 1, wherein said first protrusion means is a knob.

5. The treadmill of claim 1, wherein said second visual indicator further comprises:

indicia; and an indication member adapted to move relative to said indicia.

6. The treadmill of claim 1, wherein said indication member comprises:

a substantially horizontal base operatively connected to said first end of said axle;

an upwardly extending portion operatively connected to said base; and a substantially horizontal pointer operatively connected to said upwardly extending portion, said horizontal pointer adapted to be visibly located near said indicia.

7. The treadmill of claim 1, wherein said rear roller is adapted to move longitudinally relative to said front roller.

8. A method for placing tension on a belt of an exercise device, the method comprising the steps of:

providing a frame having a first side rail and a second side rail, wherein said second side rail is oppositely disposed from said first side rail; a front roller and a rear roller operatively connected to said frame; a deck operatively connected to said frame; a belt trained around said front roller and said rear roller; a first belt tensioning mechanism, comprising: a first rod operatively connected to said first side rail; first protrusion means for turning said first rod; and, a first visual indicator adapted to track the number of revolutions of said first rod; a second belt tensioning mechanism, comprising: a second rod operatively connected to said second side rail; second protrusion means for turning said second rod; and, a second visual indicator adapted to track the number of revolutions of said second rod; wherein each of said rear rollers has an axle passing though a longitudinal axis, said axle having first and second ends, said first end and said second end having a hole defined therein, wherein said first protrusion means and said second protrusion means each comprising a knob having said rod extending therefrom, said rod adapted to pass through said respective holes of said axle such that rotation of said first rod moves said first end of said axle, said first visual indicator further comprises indicia: and an indication member adapted to move relative to said indicia, said indication member operatively connected to said first end of said axle;

turning said first protrusion means;

moving a first end of said rear roller away from said front roller;

turning said second protrusion means;

moving a second end of said rear roller away from said front roller;

reading said first visual indicator and said second visual indicator so that a first end and a second end of said rear roller are substantially equidistant from a first end and a second end of said front roller.

9. The method of claim 8, further comprising the step of:

turning said first protrusion means and/or said second protrusion means such that said first visual indicator and said second visual indicator show that said rear roller is substantially parallel to said front roller.

10. An exercise device, comprising:

a frame having a first side rail and a second side rail, wherein said second side rail is oppositely disposed from said first side rail;

a front roller and a rear roller operatively connected to said frame;

a deck operatively connected to said frame;

a belt trained around said front roller and said rear roller;

a first belt tensioning mechanism, comprising:

a first rod operatively connected to one side of said belt;

first protrusion means for turning said first rod; and, a first visual indicator adapted to track the number of revolutions of said first rod;

a second belt tensioning mechanism, comprising:

a second rod operatively connected to the opposite side of said belt;

second protrusion means for turning said second rod; and, a second visual indicator adapted to track the number of revolutions of said second rod; wherein each of said rear rollers has an axle passing though a longitudinal axis, said axle having first and second ends, said first end and said second end having a hole defined therein, wherein said first protrusion means and said second protrusion means each comprising a knob having said rod extending therefrom, said rod adapted to pass through said respective holes of said axle such that rotation of said first rod moves said first end of said axle, wherein each of said indication members comprise:

a substantially horizontal base operatively connected to said first end of said axle;

an upwardly extending portion operatively connected to said base; and a substantially horizontal pointer operatively connected to said upwardly extending portion, said horizontal pointer adapted to be visibly located near said indicia.

11. The exercise device of claim 10, wherein said first visual indicator further comprises:

indicia; and an indication member adapted to move relative to said indicia, said indication member operatively connect to said first end of said axle.

12. The exercise device of claim 10, wherein said first protrusion means is a knob.

13. The exercise device of claim 10, wherein said protrusion means extends outwardly from said frame such that said protrusion means can be adjusted without an associated tool.

14. The exercise device of claim 10, wherein said exercise device is a treadmill.

15. The exercise device of claim 10, wherein said second visual indicator further comprises:

indicia; and an indication member adapted to move relative to said indicia.

16. The treadmill of claim 10, wherein said first belt tensioning device and said second belt tensioning device are adapted to maintain said rear roller substantially parallel to said front roller.

* * * * *